United States Patent [19]

Andersson et al.

[11] Patent Number: 4,464,008

[45] Date of Patent: Aug. 7, 1984

[54] BATTERY POST CABLE CONNECTOR

[76] Inventors: Bengt U. I. Andersson, Björkvägen 8, S-460 20 Sjuntorp; Sven B. Larsson, Myrgången 41, 461 62 Trollhättan, both of Sweden

[21] Appl. No.: 367,798

[22] Filed: Apr. 12, 1982

[30] Foreign Application Priority Data

Apr. 15, 1981 [SE] Sweden ..... 8102422

[51] Int. Cl.[3] ..... H01R 11/28

[52] U.S. Cl. ..... 339/226; 339/95 B; 339/228

[58] Field of Search ..... 339/226, 228, 95 B, 339/45, 46, 224

[56] References Cited

U.S. PATENT DOCUMENTS 1,854,489 4/1932 Sebell ..... 339/95 B X
3,307,140 2/1967 Vallinotto et al. ..... 339/226
4,062,613 2/1977 Tritenne ..... 339/95 B

FOREIGN PATENT DOCUMENTS 2339261 8/1977 France ..... 339/228
113877 4/1945 Sweden ..... 339/228

*Primary Examiner*—William R. Briggs
*Attorney, Agent, or Firm*—Holman & Stern

[57] ABSTRACT

Cable lugs for connecting to conically shaped battery posts, such as the posts on an automobile storage battery, of a type which comprises a contact element of a relatively soft material, e.g. brass, having a sleeve which conforms to and is designed for connecting to a battery post. The sleeve is forced onto the post and a conical cap made of a relatively hard material, e.g. steel, which is configured to fit the sleeve, is pressed onto the sleeve of the contact element to press the sleeve against the side surface of the battery post.

4 Claims, 3 Drawing Figures

BATTERY POST CABLE CONNECTOR

BACKGROUND OF THE INVENTION

1. Field of the Invention

The present invention relates to connectors for connecting electrical cables or wires to conically shaped battery posts, such as an automobile storage batteries.

2. Description of the Prior Art

A prior art cable lug is known from Swedish Pat. No. 113,877 wherein a contact element of a relatively soft material has a sleeve or collar part which conforms to and is designed for connecting to a generally conically shaped battery post and can be forced over the post and held fixed by a conical cap of a relatively hard material, which cap presses downward over said collar part and forces it against the side surface of the battery post. However, here the downward motion of the cap is produced by means of the top of the cap having a configuration like that of a nut, whereby said nut is screwed onto a threaded element which extends upward from the specially constructed battery post. The nut must be tightened with an adjustable wrench or the like, and there is a hazard that the sleeve or collar part of the contact element will break loose circumferentially or otherwise from said contact element.

BRIEF SUMMARY OF THE INVENTION

The object of the invention is to provide a cable connector which is easy to connect to a battery post without using an adjustable wrench or the like, and which after connection remains reliably attached to the post and can be released using a screwdriver or the like.

The above object is achieved by the invention which comprises a first contact element of a relatively soft material, such as brass, for example, which has a conically shaped collar portion, to be positioned onto the conical battery terminal, and a connector portion for attachment to a battery cable. A second conically shaped cap element of relatively hard material, such as steel for example, is forced over the first contact element on the battery post to retain the first element on the post. Screw driver apertures are provided in the second cap element for easy removal thereof by inserting the screw driver therethrough and prying against the top of the first contact element.

BRIEF DESCRIPTION OF THE DRAWINGS

The features of this invention are described in more detail hereinafter with reference to the accompanying drawings, wherein.

DETAILED DESCRIPTION

Figure 1:
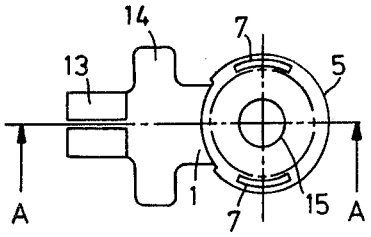
FIG. 1 is a top plan view of a cable lug according to the invention.
Figure 2:
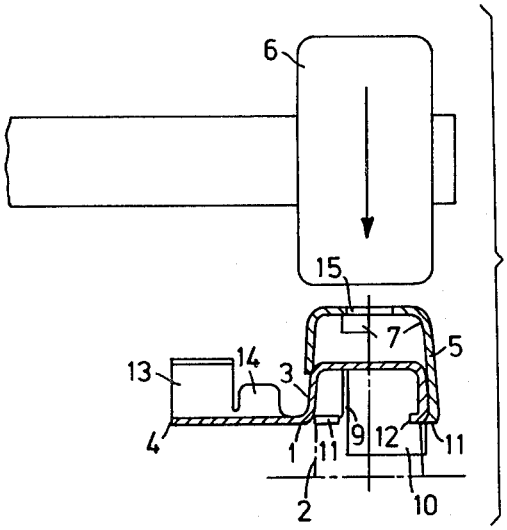
FIG. 2 is a cross-sectional view taken along line A—A of FIG. 1 of the cable lug immediately before it is pressed onto a battery post to fix it thereon.
Figure 3:
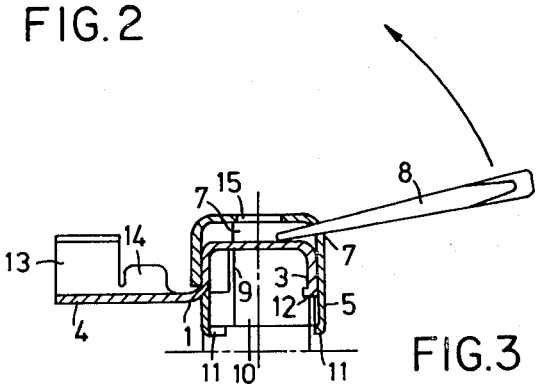
FIG. 3 is a cross-sectional view as in FIG. 2 of the cable lug after it has been pressed onto the battery post.

The cable lug of the invention is comprised of a contact element 1 made of a relatively soft material, e.g. brass, which element is provided with a conical collar part 3 configured so as to be attachable to a conical battery post 2 (shown with dot-dashed lines) by pressing said collar part over said post as shown in FIGS. 2 and 3. A projecting part 4 extending to the side serves to connect the contact element to a battery cable (not shown). A pair of flaps 13 may be bent around the battery cable, and additional connections may be made to a pair of tongue-shaped projections 14.

According to the invention the contact element 1 has associated with it a cap 5 which is pressed over or pressable over the conical collar part 3 of element 1. Cap 5 is made of a relatively hard material, e.g. steel. Its interior conical surface matches the external conical surface of said conical collar part 3.

A cable lug applied to a battery post 2 is fastened to the post by striking downward on cap 5 with a hammer 6 so that cap 5 is driven onto conical collar part 3 of contact element 1, from the position of FIG. 2 to that of FIG. 3 wherein the cap presses the conical collar part 3 tightly against the side surface of the post 2.

In order to facilitate removal of the post lug from the battery post 2, cap 5 is furnished with one or more openings 7 in the upper region of its side surface. A screwdriver 8 or the like may then be inserted in one of these openings, as shown in FIG. 3, and forced upward as shown, wherewith the end of the screwdriver pushes against the upper part of contact element 1, and the screwdriver pries the cap upward from the position of FIG. 3 to that of FIG. 2, thus releasing the squeezing action of the cap on the conical collar part 3 of contact element 1, whereby the cable lug can be readily lifted off the post 2.

The conical collar part 3 of the contact element may be divided into one or more flap sections 10 by means of vertical slits 9. This flap configuration facilitates the pressing of the conical collar part 3 against the conical outer surface of the post 2.

The cap 5 may be furnished on its bottom edge with a pair of inwardly directed ridges 11 for holding the cap on the contact element 1 in the position of FIG. 2, whereby the said inwardly directed ridges act by catching or engaging the lower edge of the conical collar part 3.

Further, the conical collar part 3 of contact element 1 may be furnished on its bottom part with one or more inwardly directed nubs, i.e., teeth 12 or the like which are pressed against the side of the post 2 when the conical collar part is squeezed, and thereby assist in holding the post lug on the post.

The top of cap 5 may have an opening 15 through which one may inspect the position of the conical collar part 3 of contact element 1 with respect to the cap.

We claim:

1. In a cable lug for connecting to a conically shaped battery post wherein a contact element made of a relatively soft electrically conducting material has a conical sleeve part, having an upper end, a lower edge and a side portion therebetween, which conforms to and can be forced over the battery post and held fixed to said battery post by a cap member, having an upper part, a lower lip and a side portion therebetween, of a relatively hard material pressed downward over said conical sleeve part to force said sleeve part against the outer surface of the battery post, the improvement comprising said cap has a conical shape substantially conforming to said sleeve part and an internal diameter at least at the lower lip which is smaller than the outer diameter of at least the lower edge of said sleeve part prior to its positioning onto the battery post, so that when forced onto and pressed downward over the sleeve part after said sleeve part has been positioned onto said battery post, said sleeve part is forced against the outer surface of the battery post by means of an axially downwardly directed force only on said cap member, and at least one opening in the side adjacent the upper part of said cap to permit the insertion of a planar shaped end of a tool between said conical sleeve part and said cap member so that the cap member can be removed by prying upwardly with said tool.

2. A cable lug according to claim 1, wherein said conical sleeve part of the contact element has a plurality of slits along its side portion to divide said side portion of the sleeve part into a plurality of flap sections which extend from a region adjacent the upper end of said sleeve part to the lower edge thereof.

3. A cable lug according to claim 2, and further comprising teeth provided on said conical sleeve, said teeth being radially inwardly directed so that they are pressed against the battery post by said cap member to retain said contact element on the battery post.

4. A cable lug according to claim 2, and further comprising radially inwardly directed ridges on the lower lip of said cap member engageable with the lower edge of said conical sleeve part for retaining said cap member on said conical sleeve part.

* * * * *